US011219928B2

(12) United States Patent
McBride

(10) Patent No.: US 11,219,928 B2
(45) Date of Patent: Jan. 11, 2022

(54) SHAPE PACKING TECHNIQUE

(71) Applicant: Electronics for Imaging, Inc., Fremont, CA (US)

(72) Inventor: James Michael McBride, Vashon, WA (US)

(73) Assignee: ELECTRONICS FOR IMAGING, INC., Fremont, CA (US)

( * ) Notice: Subject to any disclaimer, the term of this patent is extended or adjusted under 35 U.S.C. 154(b) by 259 days.

(21) Appl. No.: 16/526,802

(22) Filed: Jul. 30, 2019

(65) Prior Publication Data

US 2020/0038917 A1 Feb. 6, 2020

Related U.S. Application Data

(60) Provisional application No. 62/712,879, filed on Jul. 31, 2018.

(51) Int. Cl.

| | |
|---|---|
| ***B07C 5/38*** | (2006.01) |
| ***B07C 5/36*** | (2006.01) |
| ***B41J 11/70*** | (2006.01) |

(52) U.S. Cl.

CPC ..... *B07C 5/361* (2013.01); *B07C 5/38* (2013.01); *B41J 11/70* (2013.01)

(58) Field of Classification Search

CPC ... B07C 5/361; B07C 5/38; B41J 11/70; B41J 11/008; B41J 11/663

See application file for complete search history.

(56) References Cited

U.S. PATENT DOCUMENTS

| | | | | |
|---|---|---|---|---|
| 5,430,831 | A | 7/1995 | Snellen | |
| 6,650,433 | B1 * | 11/2003 | Keane | G06F 3/1211 358/1.15 |
| 6,976,798 | B2 * | 12/2005 | Keane | G06Q 40/00 358/1.1 |
| 7,542,155 | B2 * | 6/2009 | Paskalev | G06F 3/1263 358/1.13 |
| 7,554,689 | B2 | 6/2009 | Tonisson | |

(Continued)

OTHER PUBLICATIONS

Berm0nd et al., "Bin packing with colocations ", Jansen K., Mastrolilli M. (eds) Approximation and Online Algorithms. WAOA 2016. Computer Science, vol. 10138., Jan. 7, 2017 (Year: 2017).*

(Continued)

*Primary Examiner* — Patrick H Mackey

(74) *Attorney, Agent, or Firm* — Perkins Coie LLP

(57) ABSTRACT

A shape packing technique is introduced that can be applied in various applications such as automated print production. In an example embodiment, items that are to be placed into a target shape are sorted based on size to form item groups that include similarly sized items. Potential blocks including arrangements of one or more items are created from the sorted item groups. A placement solution is then generated by placing the potential blocks in the target shape using a recursive process that avoids redundant placement solutions until all of the potential blocks are placed or no other potential blocks are able to be placed. The placement solution can then be utilized, for example, to control a printer to print multiple images on a substrate and/or to control an automated cutting device to cut the substrate into multiple partitions according to the placement solution.

23 Claims, 13 Drawing Sheets

(56) References Cited

U.S. PATENT DOCUMENTS

| | | | | |
|---|---|---|---|---|
| 9,298,404 | B2 * | 3/2016 | Niblett, Jr. | G06F 3/1272 |
| 9,539,828 | B2 * | 1/2017 | Yasinover | G03G 15/6523 |
| 10,642,551 | B2 * | 5/2020 | Sloan, IV | G06T 7/0004 |
| 10,679,106 | B2 * | 6/2020 | Burch, Jr. | B65D 73/0028 |
| 2006/0100727 | A1 | 5/2006 | Dash et al. | |
| 2008/0144121 | A1 | 6/2008 | Malatesta | |
| 2013/0174702 | A1 | 7/2013 | Holt et al. | |
| 2014/0132988 | A1 | 5/2014 | Keane et al. | |
| 2017/0344316 | A1 * | 11/2017 | Keane | G06F 3/1211 |
| 2018/0085962 | A1 | 3/2018 | Holt et al. | |

OTHER PUBLICATIONS

Bermond , et al., "Bin packing with colocations", Jansen K., Mastrolilli M. (eds) Approximation and Online Algorithms. WAOA 2016. Computer Science, vol. 10138., Jan. 7, 2017 [retrieved Oct. 3, 2019] https://link.springer.com/chapter/10.1007/978-3-319-51741-4 entire document, especially Abstract; p. 3-10, Jan. 7, 2017.

Ortmann , et al., "New and improved level heuristics for the rectangular strip packing and variable-sized bin packing problems ", European Journal of Operational Research vol. 203, Iss. 2, Jun. 1, 2010 [retrieved on Oct. 3, 2019] https://www.sciencedirect.com/science/article/pii/S0377221709005360, entire document, especially abstract; p. 4, col. 1-2, Jun. 1, 2010.

Cintra, G. F., et al., "Algorithms for two-dimensional cutting stock and strip packing problems using dynamic programming and column generation", Science Direct; European Journal of Operational Research 191; Discrete Optimization, Aug. 23, 2007, pp. 61-85.

Jylanki, Jukka, "A Thousand Ways to Pack the Bin—A Practical Approach to Two-Dimensional Rectangle Bin Packing", retrieved from http://clb.demon.fi/files/RectangleBinPack.pdf., Feb. 27, 2010, pp. 1-50.

Martinez, Antonio , et al., "Constructive Procedures to Solve 2-Dimensional Bin Packing Problems with Irregular Pieces and Guillotine Cuts", Omega 52; retrieved online from url: https://doi.org/10.1016/j.omega.2014.10.007, Oct. 28, 2014, pp. 1-33.

Scheithauer, G., "Introduction to Cutting and Packing Optimization", Chapter 6, Optimal Guillotine Cutting; International Series in Operations Research & Management Science 263, 2018, pp. 157-181.

Zhang, Defu , et al., "A priority heuristic for the guillotine rectangular packing problem", Information Processing Letters 116, Aug. 21, 2015, pp. 15-21.

* cited by examiner

SHAPE PACKING TECHNIQUE

CROSS REFERENCE TO RELATED APPLICATION(S)

This application claims the benefit of U.S. Provisional Application No. 62/712,879, filed on Jul. 31, 2018, and titled "Rectangle Packing Technique for Guillotine Cutting," which is incorporated in its entirety by reference.

BACKGROUND

Rectangular packing algorithms determine optimal placement of rectangular items in a non-overlapping manner within a rectangular boundary. The current art consists of two primary approaches: (a) pure guillotine, and (b) maxrect. A third, more primitive, "shelf" algorithm is used to a lesser extent. Such existing approaches determine a solution by placing individual items, then resolving the "cutting" implications of the placement by determining what remaining area is available for placement of additional items. For example, with reference to FIGS. 1A-1B, a basic guillotine packing algorithm places one item (shaded box) in a target rectangle (larger box), and determines two possible guillotine cut locations for the remainder of the target rectangle, as indicated by the dotted lines. The guillotine packing algorithm then proceeds by exploring the solution space of all possible placements of items.

DETAILED DESCRIPTION

Overview

Figure 1B:
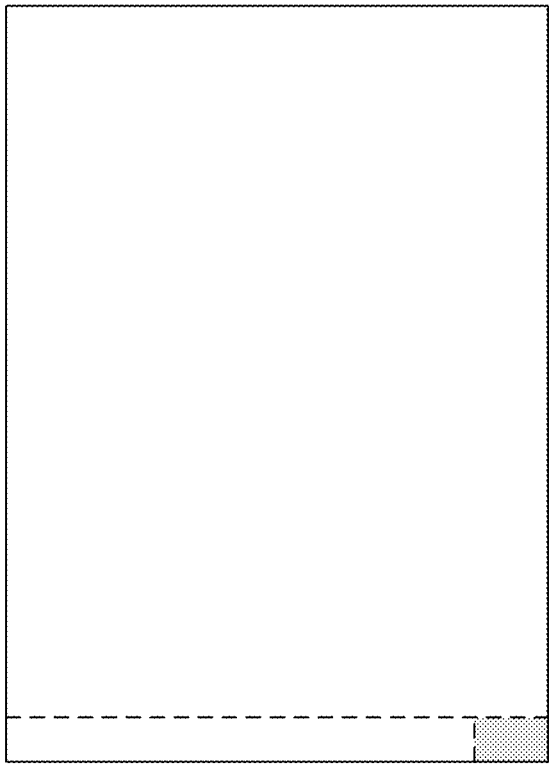
FIGS. 1A-1B show a visual representation of an existing guillotine packing algorithm.
Figure 1A:
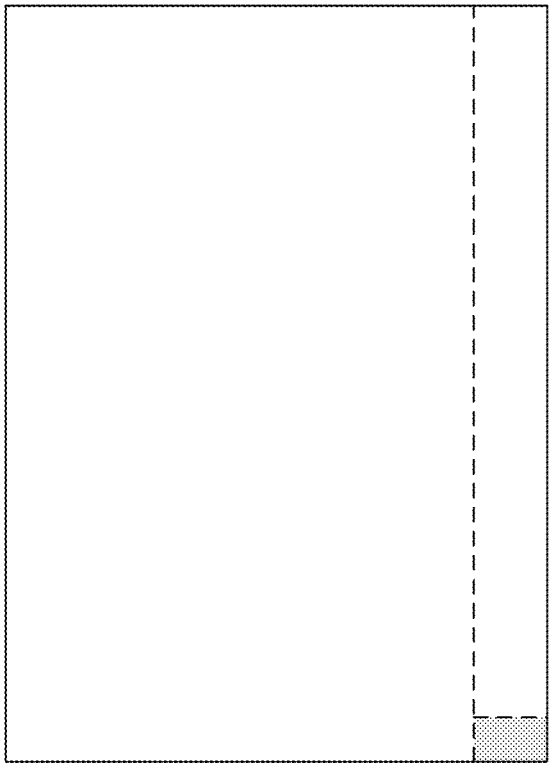
Figure 2:
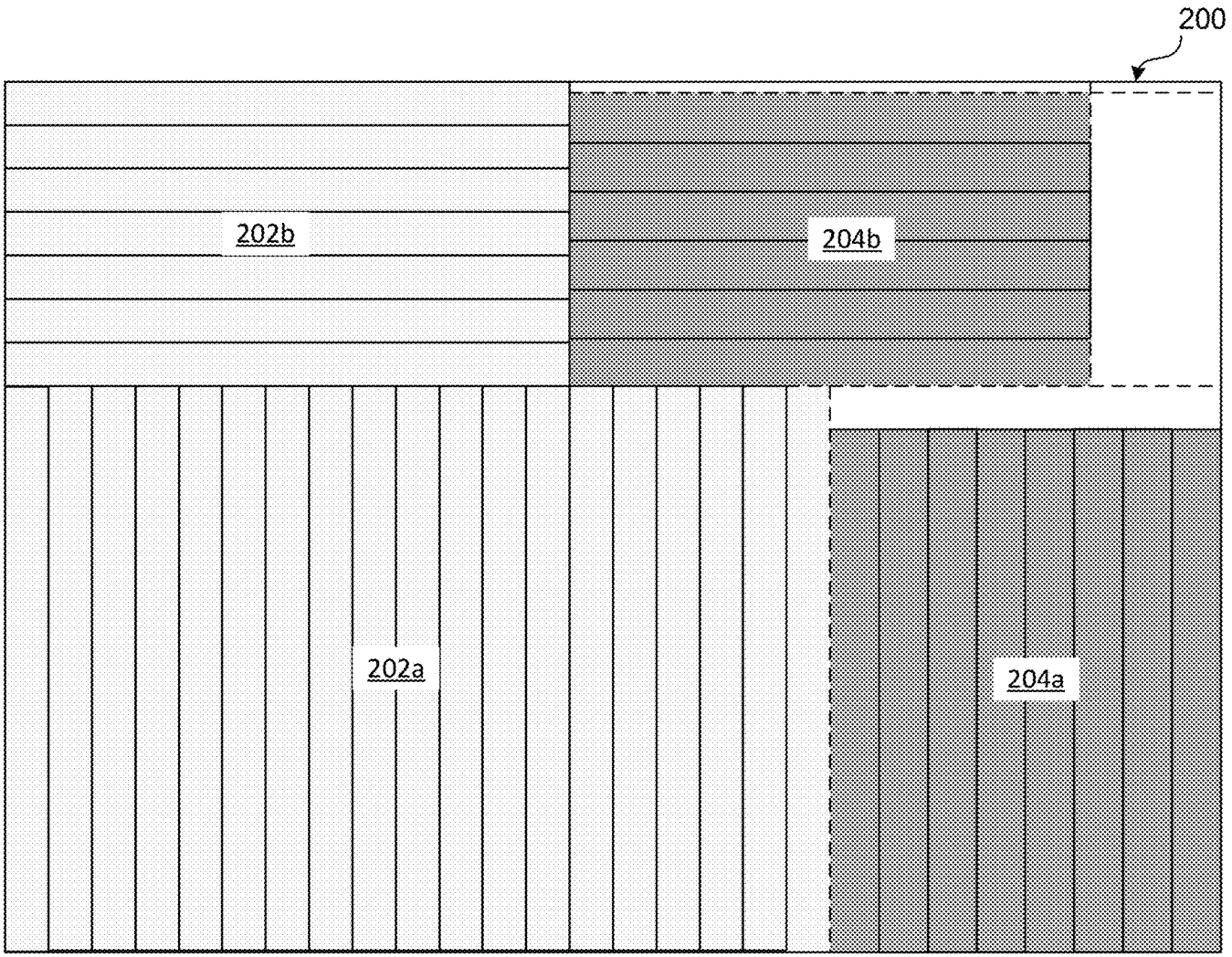
FIG. 2 shows a visual representation of an example solution generated by the introduced shape packing technique.

Existing approaches determining an optimal placement of items in a non-overlapping manner within a boundary of a shape can be slow to process and can result in inefficient solutions. To address these issues, an improved technique is introduced. In an example embodiment, items of the same or similar size are pre-grouped into "blocks" and placed as units into a target shape (e.g., a rectangle) during optimization. A two-dimensional variant of dynamic programming is then applied to recursively fill the target shape with the blocks of items while avoiding analyzing redundant areas of the solution space. FIG. 2 shows an example optimal solution based on the described technique in which four blocks have been placed. Specifically, FIG. 2 shows a target shape in the form of rectangle 200 in which blocks 202*a-b* and 204*a-b* have been placed. Block 202*a* includes a horizontal arrangement of multiple rectangular items of the same size. Block 202*b* includes a vertical arrangement of items of the same size as block 202*a*. Blocks 204*a-b* show horizontal and vertical (respectively) arrangements of items of a size different than the items in blocks 202*a-b*.

The introduced technique has broad applications ranging from packing items into a box for shipment to allocating a substrate into rectangular areas to manufacture multiple items from a common "parent" piece of substrate. The introduced technique has particular application in rectangular packing where the contained items must be separable from all other items by a series of guillotine "cuts" running from one edge of an "uncut" rectangle to the opposite edge of that same rectangle. Accordingly, for simplicity, various embodiments of the introduced technique are described in the context of defining guillotine "cuts"; however, a person having ordinary skill in the art will recognize that the technique can also be applied to other areas such as packing items in a box for shipment. Further, while various embodiments of the introduced technique are described into the context of packing rectangular shapes into a target rectangular shape, a person having ordinary skill in the art will recognize that the introduced technique can similarly be applied to pack other types of shapes including non-rectangular shapes such as triangles, rhombuses, rhomboids, trapezoids, etc. Still further, while various embodiments of the introduced technique are described in the context of packing two-dimensional (2D) shapes into a target 2D shape, a person having ordinary skill in the art will recognize that the introduced technique can similarly be applied to pack three-dimensional (3D) volumetric shapes (e.g., cubes, cuboids, triangular prisms, etc.) into target 3D volumetric shapes.

The introduced technique improves on existing approaches by addressing several problems with existing approaches such as the following:

- Time to solution: Improving (i.e., reducing) the amount of time to determine a solution can have particular impact in print planning and production systems that include higher-level algorithms for optimizing grouping of products into individual production runs. These higher-level algorithms may heavily rely on the performance of the shape packing algorithm(s) applied. Improving the speed at which a shape packing algorithm produces a solution will generally improve the overall speed of the higher-level production algorithms.
- Quality of solution for area allocated: Results based on application of the introduced technique have shown gains in percentage of "parent" piece of substrate used to produce saleable product. In other words, less of the substrate remains unallocated to candidate items. This results in less material waste and lower distributed production costs in any application.

Quality of solution for minimal cutting: The pre-grouping of similar sized items used by the introduced technique provides for a more favorable item layout that requires fewer cuts to manufacture. Consider, for example, the cutting plan for the solution depicted in FIG. 2. Fewer cuts during production reduces the amount of time needed to perform the cuts, reduces wear on cutting equipment, and lowers the chances of errors during the cutting process. This all results in reduced production costs in any application.

Shape Packing Technique

Figure 3:
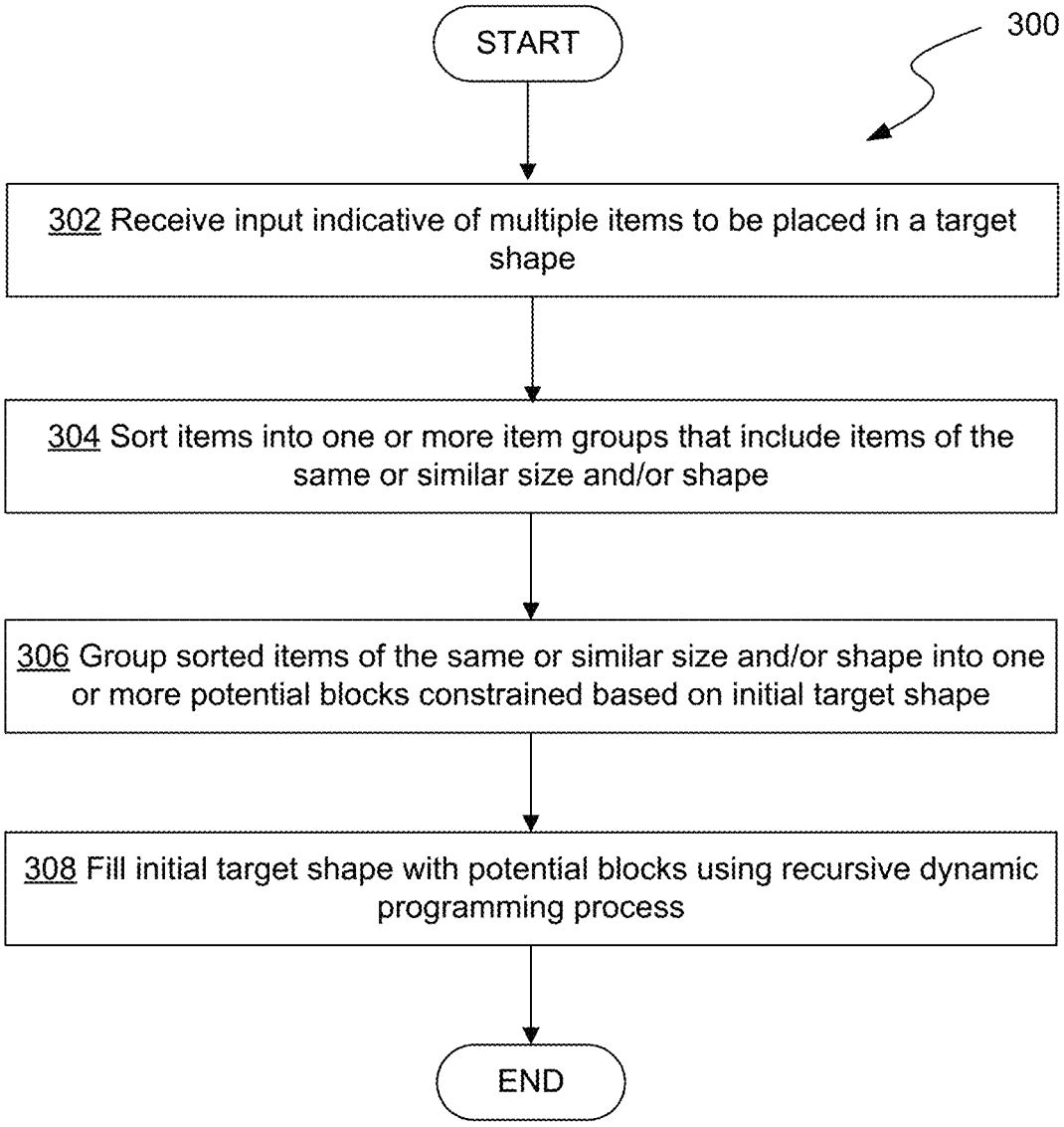
FIG. 3 shows a flow diagram of an example process for performing an embodiment of the introduced shape packing technique.

FIG. 3 shows a flow diagram of an example process 300 for performing a shape packing technique, according to some embodiments of the introduced technique. The example process 300 may be performed by a computing system (e.g., such as computing system 900 described with respect to FIG. 9). For example, the example process 300 may be represented in instructions stored in memory that are then executed by a processor. The process 300 described with respect to FIG. 3 is an example provided for illustrative purposes and is not to be construed as limiting. Other processes may include more or fewer steps than depicted while remaining within the scope of the present disclosure. Further, the steps depicted in example process 300 may be performed in a different order than is shown.

Example process 300 begins at step 302 with receiving an input indicative of a plurality of items to be placed in a target shape. An "item" in this context may refer, for example, to individual instances of image to be printed, a box to be packaged, a part to be cut from a substrate, etc. For example, in the commercial printing industry, the production of commercially imaged media sheets may include more than one media instance of a product, or more than one product, that can be positioned on a media sheet. Before imaging, the instances may be displayed in a layout, which for purposes of this description means a virtual depiction of a number of media instances. After imaging, the individual instances or items in the layout are cut into individual products, for example, using a "guillotine cutting" process.

Accordingly, each item indicated in the input received at step 302 may have a corresponding shape with associated dimensions. For example, in some embodiments, each of the items indicated in the input received at step 302 is a rectangle having two dimensions: height and width. In some embodiments, the item is a two-dimensional (2D) representation of an otherwise three-dimensional (3D) physical object such as a physical box. For example, an "item" in this context may include a 2D rectangular footprint of the 3D physical box. In some embodiments, the item itself may be associated with more than two dimensions. For example, in some embodiments, shape associated with a given item may be a volumetric shape having three dimensions: height, width, and length. For example, an item having a 3D volumetric shape may represent the volume of a physical product that is to be packed into a physical box.

Example process 300 continues at step 304 with sorting at least some of the plurality of items indicated at step 302 into one or more item groups. In some embodiments, the items are sorted based on size and/or shape. For example, the sorting of items based on size and/or shape may include sorting a set of items having different dimensions into multiple groups where each of the multiple groups includes a subset of the overall set of items having the same or similar dimensions. In other words, this step may include grouping a subset of items that satisfy a similarity criterion and assigning those items to a particular item group. The similarity criterion may specify that all items in an item group have the exact same dimensions and/or may specify a threshold requirement to be considered similar. The threshold requirement may include a specified value such as within 0.2 inches of each other. In this example, items that are 1.9 inches in width may be grouped with other items that are 2.0 inches or 2.1 inches in width. In other embodiments, the threshold requirement may specify a percentage values such as within 10% of a mean value. In this example, an item that is 1.8 inches in width may be grouped with another item that is 2.2 inches in width where the mean value for the group is 2.0 inches. Further, the sorting of items may be performed without regard to orientation. For example, a first item properly oriented with a width of 2 inches and a height of 5 inches may be grouped together with a second item properly oriented with a width of 5 inches and a height of 2 inches. These are just illustrative examples of similarity criteria and are not to be construed as limiting. Other types of similarity criteria can also be applied depending on the requirements of a given embodiment.

In some embodiments, step 304 includes processing data received in the input of step 302 to sort the one or more items. The type of processing performed at step 304 will depend on the nature of the data received at step 302. For example, in some embodiments, data received at step 302 may include a set of dimensions associated with the plurality of items. In such an embodiment, the dimensions of the plurality of items may be input into a sorting algorithm to group the items based on their dimensions.

In other embodiments, the data received at step 302 may require further processing to determine the dimensions associated with the items. For example, the input received at step 302 may include a set of images that are to be printed on a substrate. In such an example, step 204 may include processing the images to determine the dimensions associated with items (e.g., rectangular shapes) that represent the images. In some embodiments, this can include extracting metadata from an image file that indicates the dimensions of the image, reading page setup information included in a print job that indicates the final print size for the images, etc. In some embodiments, step 304 may include querying or otherwise accessing an external database for information regarding the dimensions of the various items indicated at step 302. For example, the input received at step 302 may include an indication of a number of products that are to be packed in a physical box. This indication may be in the form of a set of identifiers (e.g., universal product codes (UPC)) associated with the products that are to be packed in a box. In such an example, step 304 may include accessing an external database to retrieve the dimensions of the products associated with the identifiers.

In some embodiments, a machine learning model implementing one or more clustering algorithms may be applied to sort the various items into one or more groups based on size and/or shape. For example, dimensions of the various items may be input into a clustering model to output a set of items sorted based on dimensional similarities. Examples of clustering algorithms that can be applied include K-means clustering, mean-shift clustering, hierarchical clustering, etc.

Figure 4A:
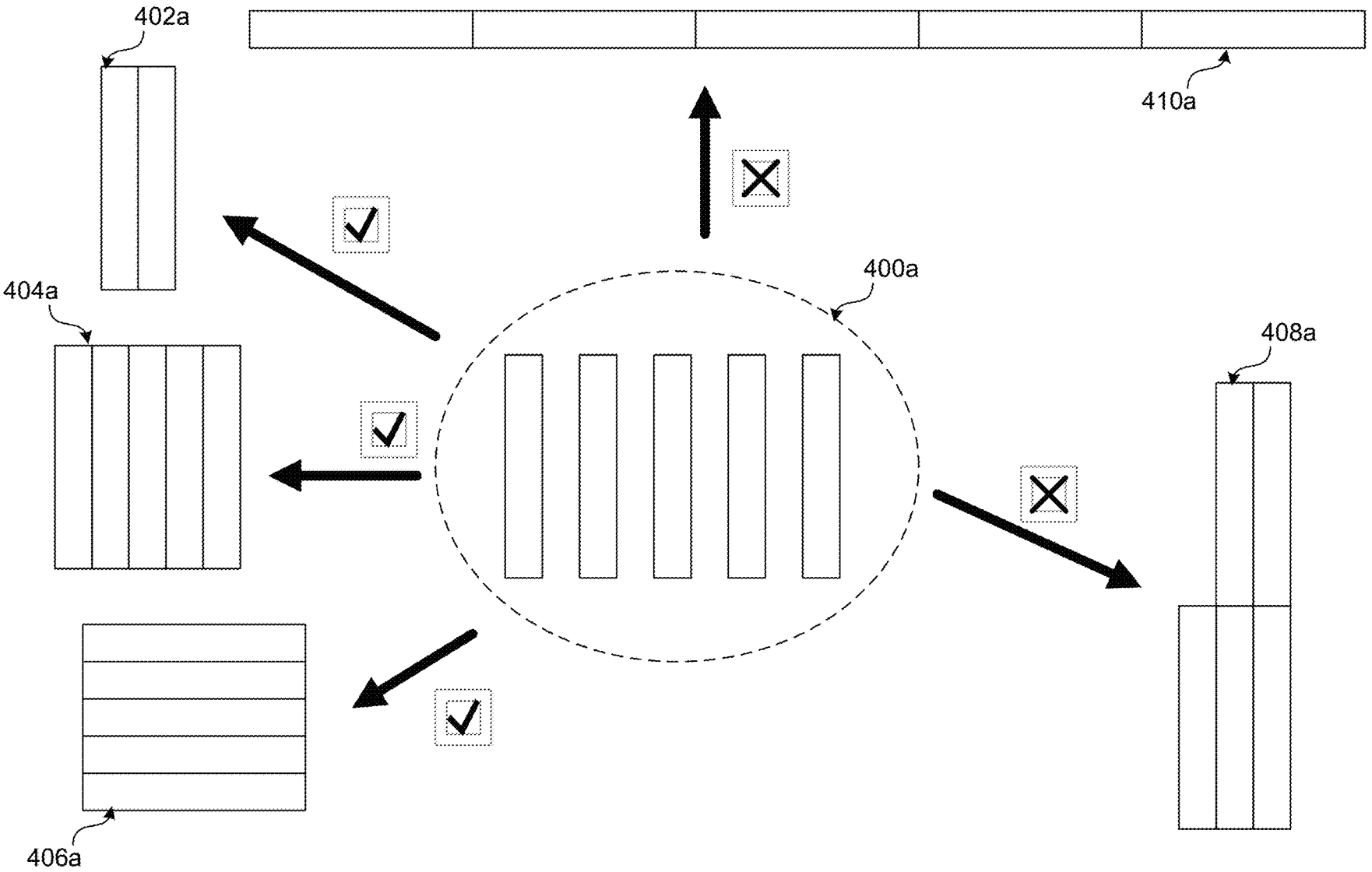
FIG. 4A shows a diagram that illustrates how rectangular items are grouped into blocks, according to an embodiment of the introduced shape packing technique.

The example process 300 continues at step 306 with creating, generating, or otherwise defining potential "blocks" using the sorted items of the same or similar size (i.e., dimensions). In an example embodiment, the "blocks" are rectangular arrangements of similarly sized rectangular items in rows and columns ranging from a single item up to the maximum number of items of this similar size indicated in the input received at step 302. In other words, in some embodiments, step 306 may include defining one or more potential blocks for each item group of substantially similar items. For example, FIG. 4A shows an example grouping of five similarly sized rectangular items as indicated by the dotted line 400*a*. The five items included in the grouping can be arranged into multiple different rectangular block configurations such as the example blocks 402*a*, 404*a*, and 406*a*.

In some embodiments, the potential blocks are constrained to be rectangular such that irregular arrangements such as arrangement 408*a* do not qualify as a block. Further, the potential blocks are constrained to the dimensions of a target shape rectangle. For example, although a rectangle, arrangement 410*a* may not qualify as a block if its longest dimension (e.g., width) exceeds that of the longest dimension of the target rectangle. The target rectangle may be based on the dimensions of, for example, a piece of substrate (e.g., a media sheet on which items are to be printed and cut from) a box within which items are to be packaged, or any other real-world dimensional constraint.

It shall be appreciated that the potential blocks 402*a*, 404*a*, and 406*a* depicted in FIG. 4A do not necessarily represent the complete set of potential blocks based on the grouping 400*a*. As mentioned, each potential block may include as few as one item and up to the total number of items included in the sorted group. For example, potential block 402*a* only includes two items, while potential blocks 404*a* and 406*a* include all five items. Other potential blocks not shown may include one or four items. Further, in some embodiments, the set of potential blocks may include both orientations of a particular arrangement of items. Consider, for example, the horizontal arrangement of five items in block 404*a* and the corresponding vertical arrangement of the same five items in block 406*a*.

Figure 4B:
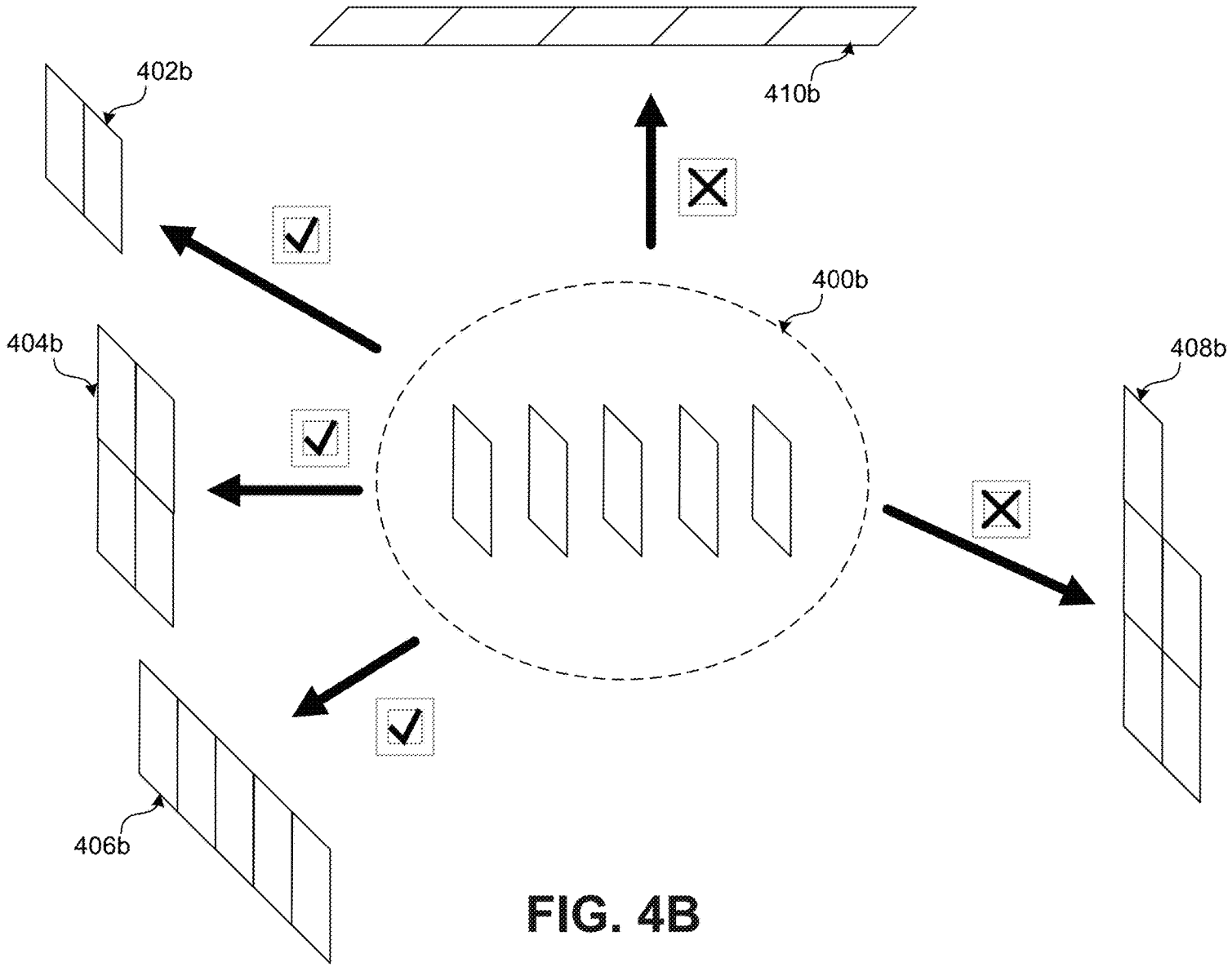
FIG. 4B shows a diagram that illustrates how non-rectangular items may be grouped into blocks, according to an embodiment of the introduced shape packing technique.

Further, as previously discussed, the introduced technique can also be applied to pack shapes other than rectangles. FIG. 4B shows a diagram of an example grouping of five non-rectangular shapes (specifically, rhomboids) as indicated by the dotted line 400*b*. Similar to the rectangular items of FIG. 4A, the five non-rectangular items included in the grouping 400*b* can be arranged into multiple different groups 402*b*, 404*b*, and 406*b*.

Also, as discussed with respect to FIG. 4A, the potential blocks of rhomboid-shaped items in FIG. 4B may be constrained to be rhomboids such that irregular arrangements such as arrangement 408*b* do not qualify as a block. Further, the potential blocks are constrained to the dimensions of a target shape. For example, although a rhomboid, arrangement 410*b* may not qualify as a block if its longest dimension (e.g., width) exceeds that of the longest dimension of the target shape.

Returning to FIG. 3, the example process 300 continues at step 308 with proceeding to fill the target shape with potential blocks generated at step 304 using a recursive dynamic programming variant. The process of filling the target shape with blocks is described in more detail with respect to FIG. 5.

Figure 5:
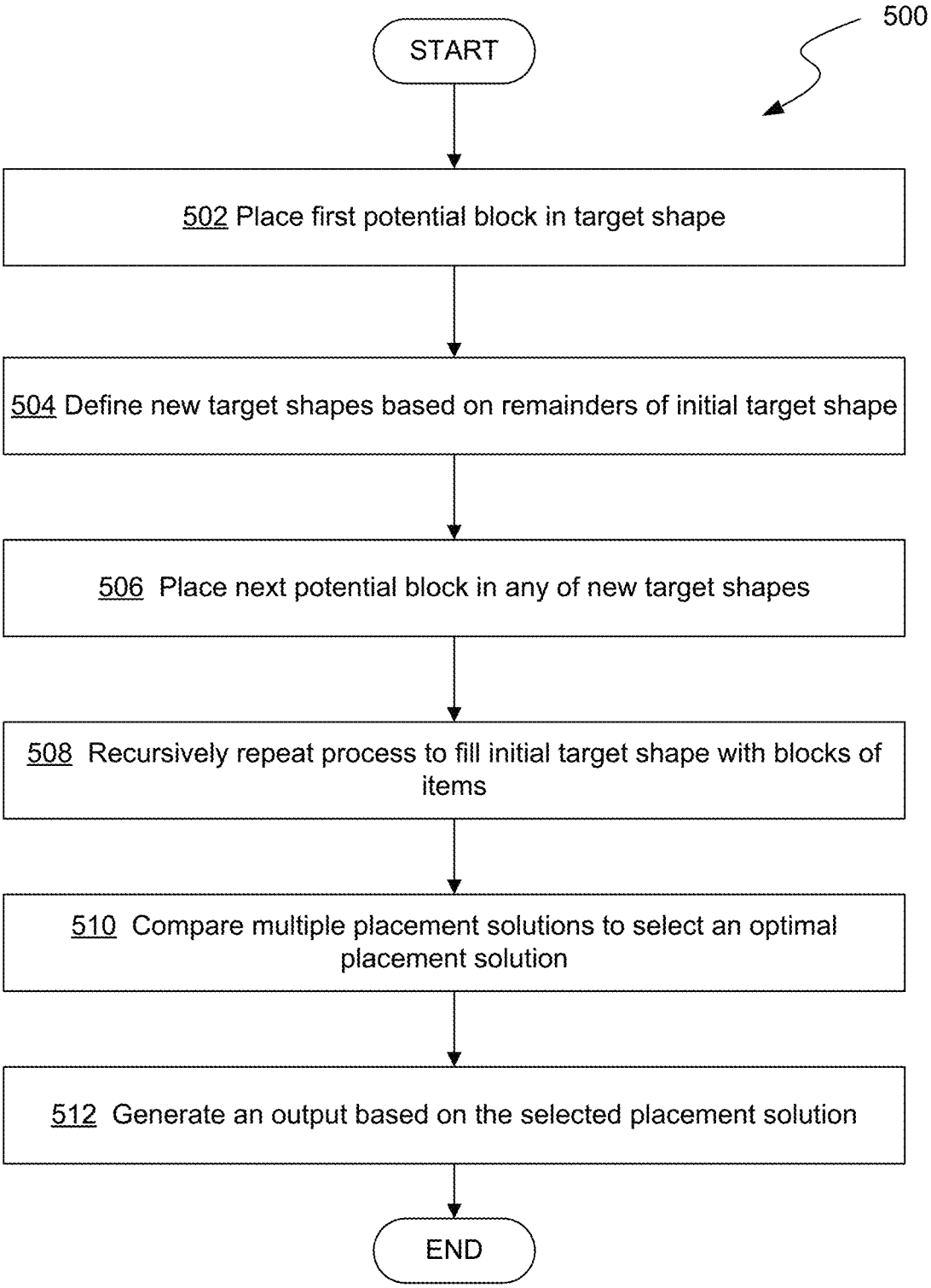
FIG. 5 shows a flow diagram of an example process for recursively filling a target shape with blocks, according to an embodiment of the introduced shape packing technique.

FIG. 5 shows a flow diagram of an example process 500 for placing blocks in a target shape (specifically, a rectangle) according to the introduced technique. The example process 500 may represent sub steps of step 308 in example process 300. As with example process 300, process 500 may be performed by a computing system (e.g., such as computing system 900 described with respect to FIG. 9). For example, the example process 500 may be represented in instructions stored in memory that are then executed by a processor. The process 500 described with respect to FIG. 5 is an example provided for illustrative purposes and is not to be construed as limiting. Other processes may include more or fewer steps than depicted while remaining within the scope of the present disclosure. Further, the steps depicted in example process 500 may be performed in a different order than is shown.

Example process 500 begins at step 502 with placing a first potential block in the target rectangle. The first potential block to be placed is selected from the set of potential blocks generated, for example, at step 304 in process 300. The potential blocks to be placed may be sorted by size (e.g., primarily by width and secondarily by height). A target rectangle is then defined, for example based on input information regarding dimensions of a substrate such as a paper media sheet. In some embodiments, the first block placed at step 502 is the largest (e.g., primarily by width) potential block that fits within the target rectangle. For simplicity of explanation, placement of a block will be in the lower left corner of the destination rectangle, but due to symmetry could be in any corner.

In some embodiments, a block may be selected for placement in the target rectangle if the block satisfies the following conditions:

The block includes a quantity of items that still need to be placed in the target rectangle;

The block fits in the target rectangle; and

The block does not represent a potential block that can be produced by a partition to any previously placed potential block. Stated otherwise, the block does not represent a block that can be produced by a vertical cut made to any previously placed block to the left of this block and does not represent a block that can be produced by a horizontal cut made to any previously placed block below this block. This is because it is known that a block representing the combination of the two blocks has already been tested, and due to the guillotine cutting constraint of the algorithm, it does not matter where this additional block is placed—it is still effectively a redundant solution.

The third constraint noted above is based on dynamic programming inspiration to avoid redundant testing of block placements. By avoiding testing redundant block placements, the technique improves efficiency.

After the first block (e.g., the largest block) is placed (e.g., in the lower left corner of the target rectangle at step 502), the remainder of the target rectangle is divided or "cut" at both a right edge of the placed block and a top edge of the placed block to define two remaining rectangles, potentially of zero area. Note that the act of cutting at this step may include just defining a cut line or dividing the area of the remainder of the target rectangle.

At step 504, a new target rectangle is defined based on the remainders of the initial target rectangle. For example, in some embodiments, the cut that produces the rectangle of the largest area is selected first, and both rectangles resulting from this cut are used to define new target rectangles to be filled recursively by other blocks. In some embodiments, the rectangles resulting from the other cut are also filled recursively. In other words, a next potential block may be placed at step 506 in any of the new target rectangles and this process can continue (as indicated at step 508) to recursively define new target rectangles and fill the new target rectangles with potential blocks until all the blocks have been placed or no other blocks are able to be placed.

Step 508 can be recursively repeated while avoiding redundant placement solutions, for example, by applying the previously mentioned block placement constraints.

The results of the multiple placement solutions can then be compared at step 510 to select an optimal placement solution. The optimal placement solution selected at step 510 may be the placement solution that results in most of the target shape being filled with potential blocks. Alternatively, or in addition, the optimal placement solution may be the placement solution that places the fewest blocks and/or requires the fewest cuts. Other constraints may similarly be applied to define which of the multiple placement solutions is an optimal solution.

In some embodiments, the introduced technique first attempts to find a solution with a minimal number of placed blocks. If no solution is found using this approach, the number of blocks allowed can be increased one block at a time. This provides a more focused first search of the solution space which may lead to more ideal solutions since fewer placed blocks require fewer cuts, and solutions can be found more quickly. As the number of blocks allowed is increased, the depth of the solution space being searched is also increased. For example, the solution depicted in FIG. 2 shows an optimal solution that was found when four blocks were allowed, but could not be found with fewer blocks, and would not improve with more blocks.

Example process 500 concludes at step 512 with generating an output based on the selected placement solution. In some embodiments, this step may include presenting the selected placement solution to a user, for example, by displaying a visual representation of the placement solution via a display of a user computing device (e.g., personal computer, mobile device, etc.). In other embodiments, the output generated at step 512 may include instructions or other information that is useable by one or more components of an automated production system to perform a production process. For example, the output generated at step 512 may include a print layout that is useable by a printer (e.g., inkjet, laser printer, etc.) to print a plurality of images on print media (e.g., paper). As another example, the output generated at step 512 may include a cutting pattern that is useable by an automated cutting system (e.g., an automated guillotine cutter) to cut a substrate (e.g., a print media) into multiple partitions. As another example, the output generated at step 512 may include a placement sequence that is useable by an automated packaging system to place multiple physical products into a box for shipping. As another example, the output generated at step 512 may include a resource allocation. Resources in this example may include computing resources such as processing, memory, storage, etc. In such an example, items place in a target shape may represent resource allocation requests for certain computing tasks. In some embodiments, the two dimensions of an item shape may represent two different resources (e.g., processing and memory). The target shape in this example would represent the available resources. The placement solution would therefore represent a resource allocation solution to process one or more of the task using the available resources.

In some embodiments, the output generated at step 512 may include control commands that are readable by a device such as a printer or automated cutter to perform a production process. In other embodiments, the output generated at step 512 may include data (e.g., instructions, job definition files, etc.) that are interpreted and translated by a controller device into control commands that are readable by a device such as a printer or automated cutter to perform a production process. For example, a computer system may output a job file at step 512 that is based on the placement solution. The job file may be input to a printer controller that interprets the job file and translates the job file into control commands or other machine-readable instructions that are used by a printer to print images onto a substrate according to the placement solution.

Figure 6A:
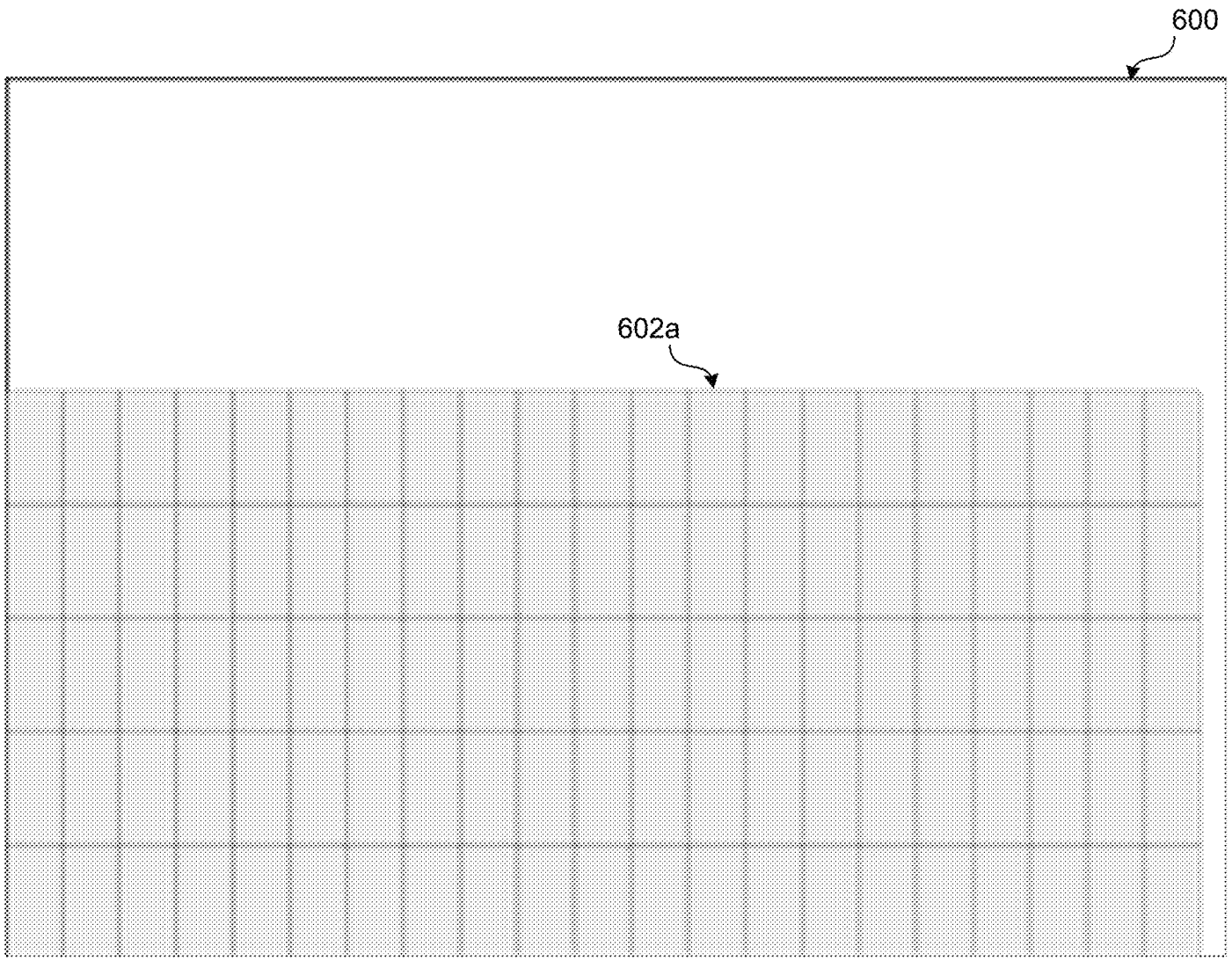
FIGS. 6A-6C show a sequence of visual representations of iterative solutions that illustrate an example process for performing an embodiment of the introduced shape packing technique.
Figure 6B:
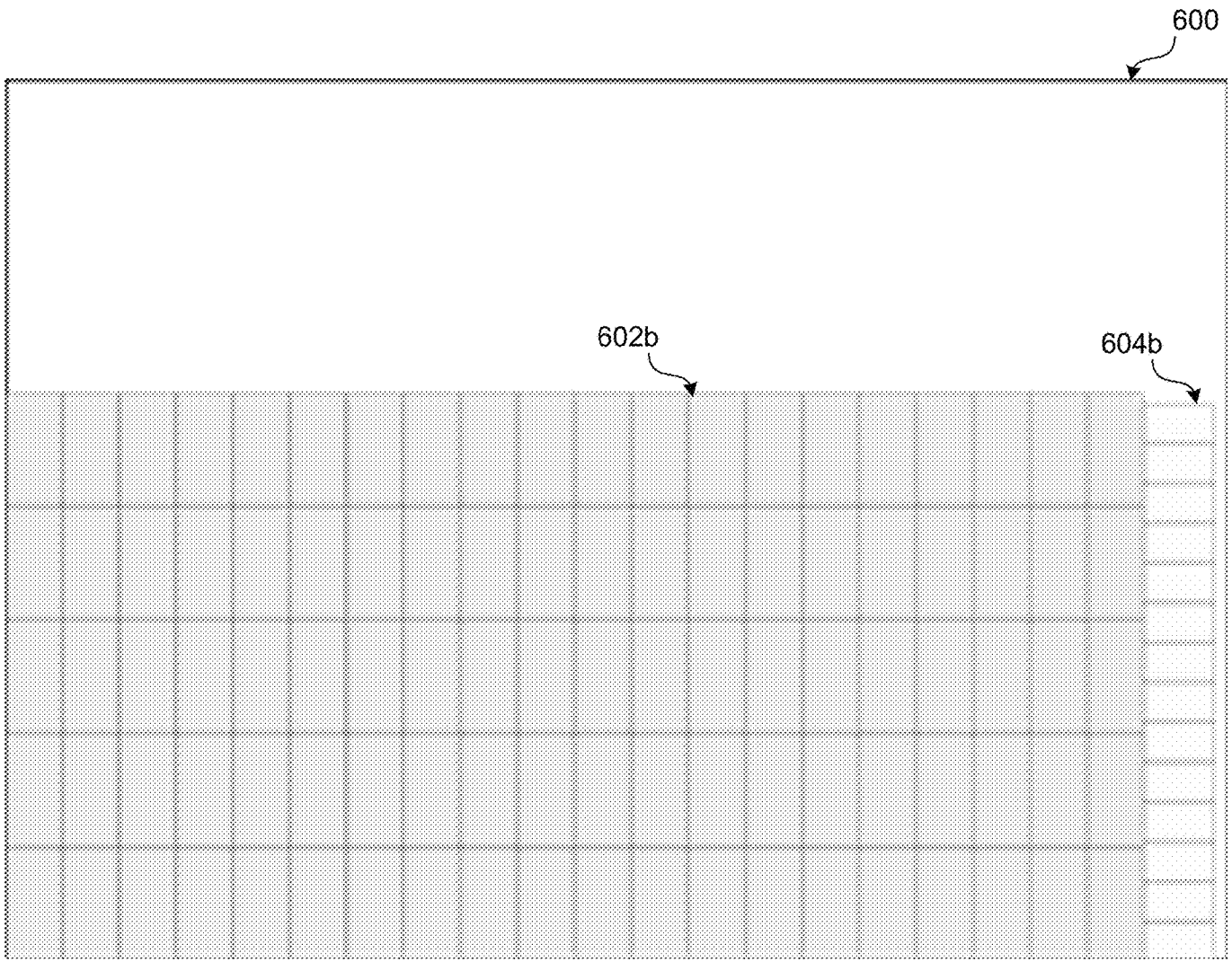

FIGS. 6A-6D depict an example sequence of placement of blocks in a target rectangle to further illustrate the processes described with respect to FIGS. 3-5. Again, for simplicity of explanation, placement of blocks is described as beginning in a lower left corner of the destination rectangle, but due to symmetry could be in any corner. Further, the placement of blocks depicted in FIGS. 6A-6B is only shown in one dimension for illustrative simplicity; however, in practice, the process would be performed in two dimensions.

The process begins by placing a first block 602 in the target rectangle 600 as shown in FIG. 6A. In this example, block 602*a* comprises a rectangular arrangement of 105 items of equal size. In some embodiments, the process may begin with placing the largest potential block that can fit into the target rectangle 600. Specifically, in the example depicted in FIG. 6A, the process may begin with selecting the widest potential block that fits in the target rectangle 600.

Since there is still available space to be filled to the right of block 602*a*, and since that remainder space is too small to fit any other potential blocks, the process may try a next smaller potential block 602*b* that includes the same items as block 602*a* and then try to place another potential block in the new remainder space, for example, as shown in FIG. 6B. As shown in FIG. 6B, the process has replaced block 602*a* with block 602*b* which represents a next smaller version of block 602*a*. Specifically, block 602*b* comprises a rectangular arrangement of 100 items with one less column of items as compared to block 602*a*. Now, with the increased remainder space, the process places another block 604*b* to the right of block 602*b*. In this example, block 604*b* comprises a rectangular arrangement of 14 items of an equal size that differ from the size of the items of block 602*b*.

Figure 6C:
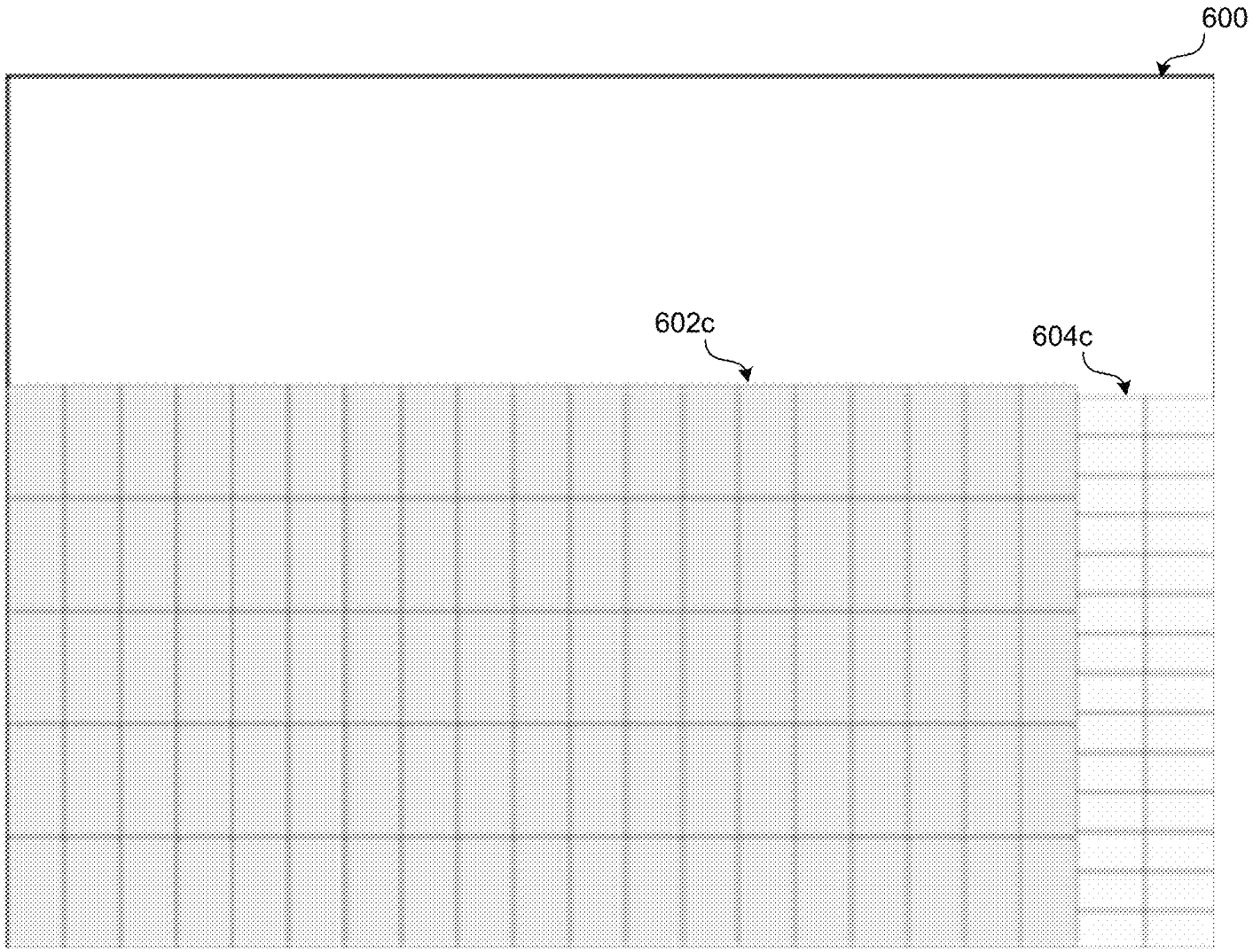

Since there is still available space to the right of blocks 602*b* and 604*b*, the process may try to fill a remainder space after the first block with the widest block that can fit in that remainder space and that does not represent a sub-block of any previously placed block. For example, as shown in FIG. 6C, the process may instead try a next smaller potential block 602*c*. Specifically, the next smaller block 602*c* comprises a rectangular arrangement of 95 items with one less column of items as compared to block 602*b*. With the next smaller block 602*c*, the process can now fill the remainder space with another block 604*c* comprising an arrangement of 28 items of the same size as block 604*b*, but with one more column of items as compared to block 604*b*. As shown in the example solution depicted in FIG. 6C, the remainder space to the right of blocks 602*c* and 604*c* is reduced (e.g., to zero) relative to the solution depicted in FIG. 6B. In other words, the solution depicted in FIG. 6C is more efficient than the solutions depicted in FIGS. 6A-6B since less area of the target rectangle is wasted.

Due to guillotine cutting geometry, starting with the largest block guarantees any sub-block of the same height or width of any placed block has effectively already been tested and will never need be tested in the dimension that would increase the placed block size to a size that was already tested. Specifically, any sub-block that can be created by a horizontal cut of an already placed block never needs to be tested above the placed block, as this will represent the testing of a redundant solution. Similarly, any sub-block that can be created by a vertical cut of an already placed block never needs to be tested to the right of the placed block.

Figure 6D:
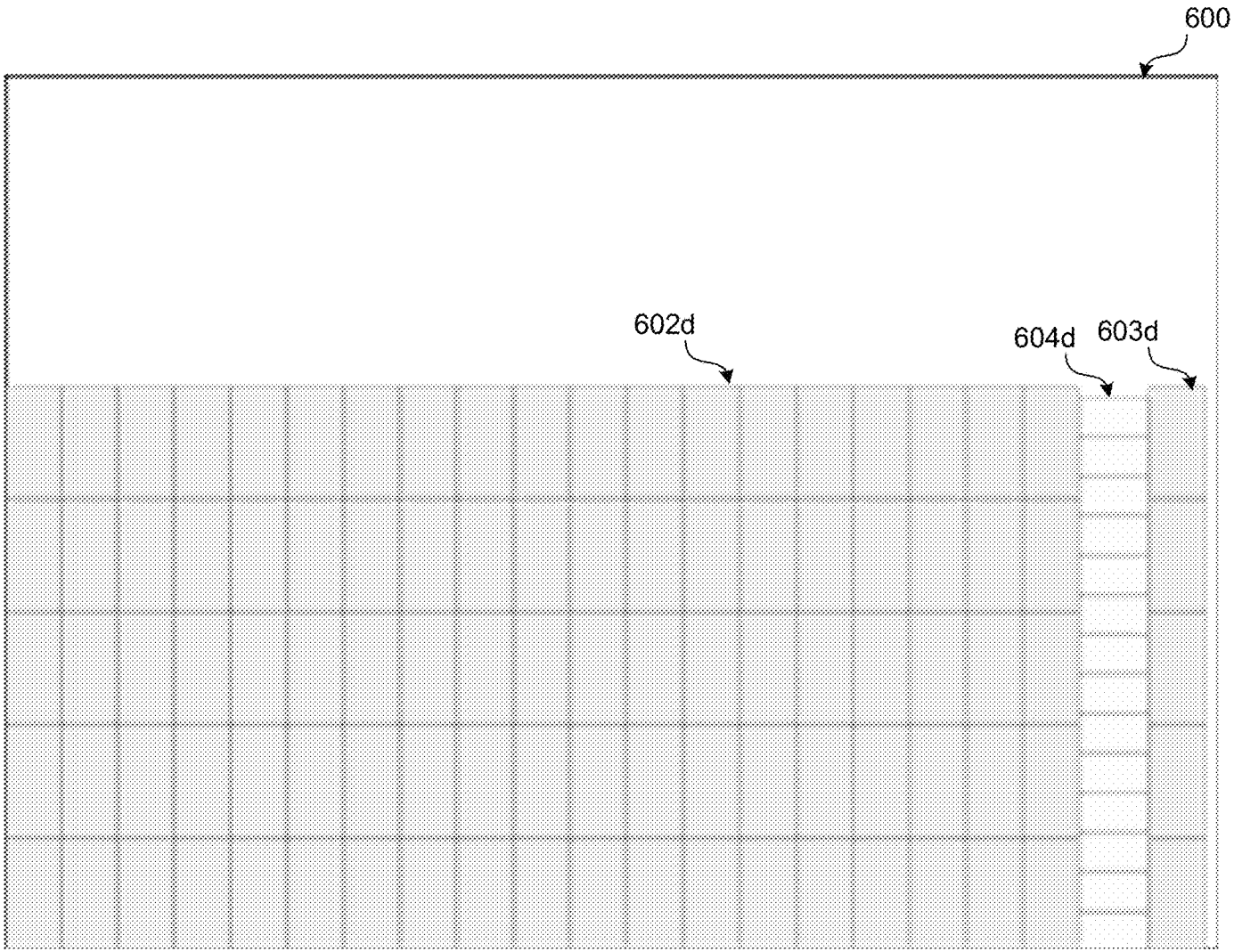
FIG. 6D shows an example redundant arrangement that can be skipped when testing iterative solutions in the example process illustrated in FIGS. 6A-6C.

Consider, for example, the arrangement depicted in FIG. 6D that includes a first block 602*d* having 95 items of a first size (e.g., similar to block 602*c* in FIG. 6C), a second block 604*d* having 14 items of a second size (e.g., similar to block 602*b* in FIG. 6B), and a third block 603*d* representing a sub-block of block 602*d* having 5 items of the same size as a block 602*d*. Considering geometric rearrangement allowed by swapping items on the sides of any guillotine cut, it can be seen that the arrangement depicted in FIG. 6D is redundant to the solution depicted in FIG. 6B, and therefore does not need to be tested. As previously discussed, a variant of a dynamic programming process can be applied in some embodiments of the introduced technique to avoid testing such redundant arrangements and thereby increase overall efficiency of the process.

As previously mentioned, the sequence shown in FIGS. 6A-6C depicts an example operation of a process in accordance with the introduced technique, but only in the horizontal direction (i.e., in one dimension). The actual process may proceed recursively in both dimensions. In other words, after each block is placed, the process will attempt to fill remaining space in both directions with a largest available block. If no solution is found, then the process will backtrack to try combinations using smaller blocks.

Example Implementations for the Shape Packing Technique

Figure 7:
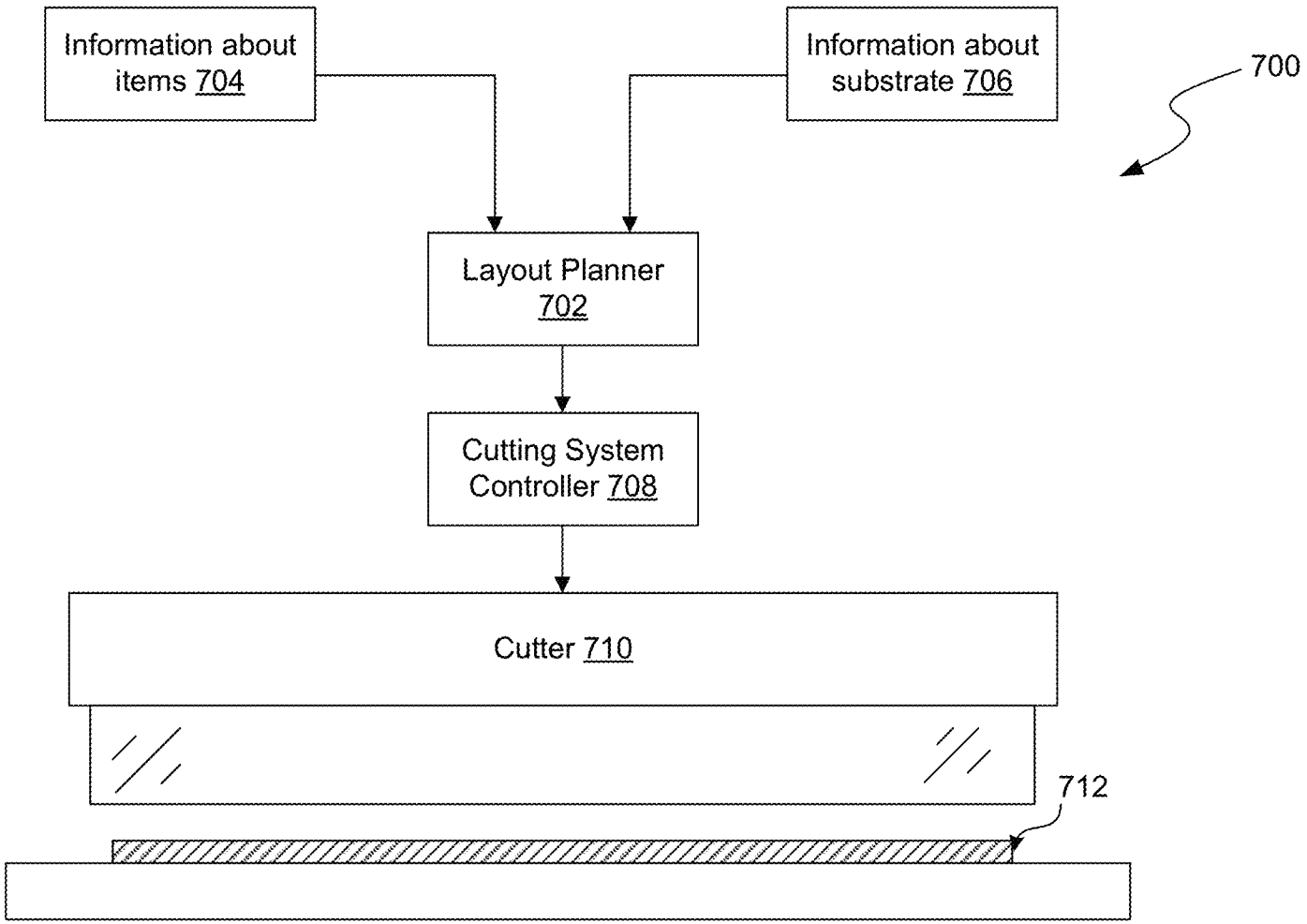
FIG. 7 shows a diagram of an example cutting system within which the introduced shape packing technique can be performed.

As previously mentioned, packing solutions generated using the introduced technique can be implemented in a number of different applications such as arranging items in a box for shipment or allocating a substrate into rectangular areas to manufacture multiple items from a common "parent" piece of substrate. FIG. 7 shows an example guillotine cutting system 700 configured to cut a substrate 712 such as a media sheet (e.g., paper) into multiple partitions. As shown in FIG. 7, the example system includes a layout planner 702 configured to receive inputs such as information 704 regarding a set of candidate items to be produced and information 706 regarding a substrate 712 from which the candidate items are to be cut. The information 704 regarding the items may include, for example, image files (if applicable), indications of the shape and/or dimensions of the items, indications of the physical objects corresponding to the items, and/or descriptions of any other characteristics of the items. The information 706 regarding the substrate 712 may include, for example, indications of the shape and/or dimensions of the substrate, an indication of a material of the substrate, and/or descriptions of any other characteristics of the substrate.

Figure 9:
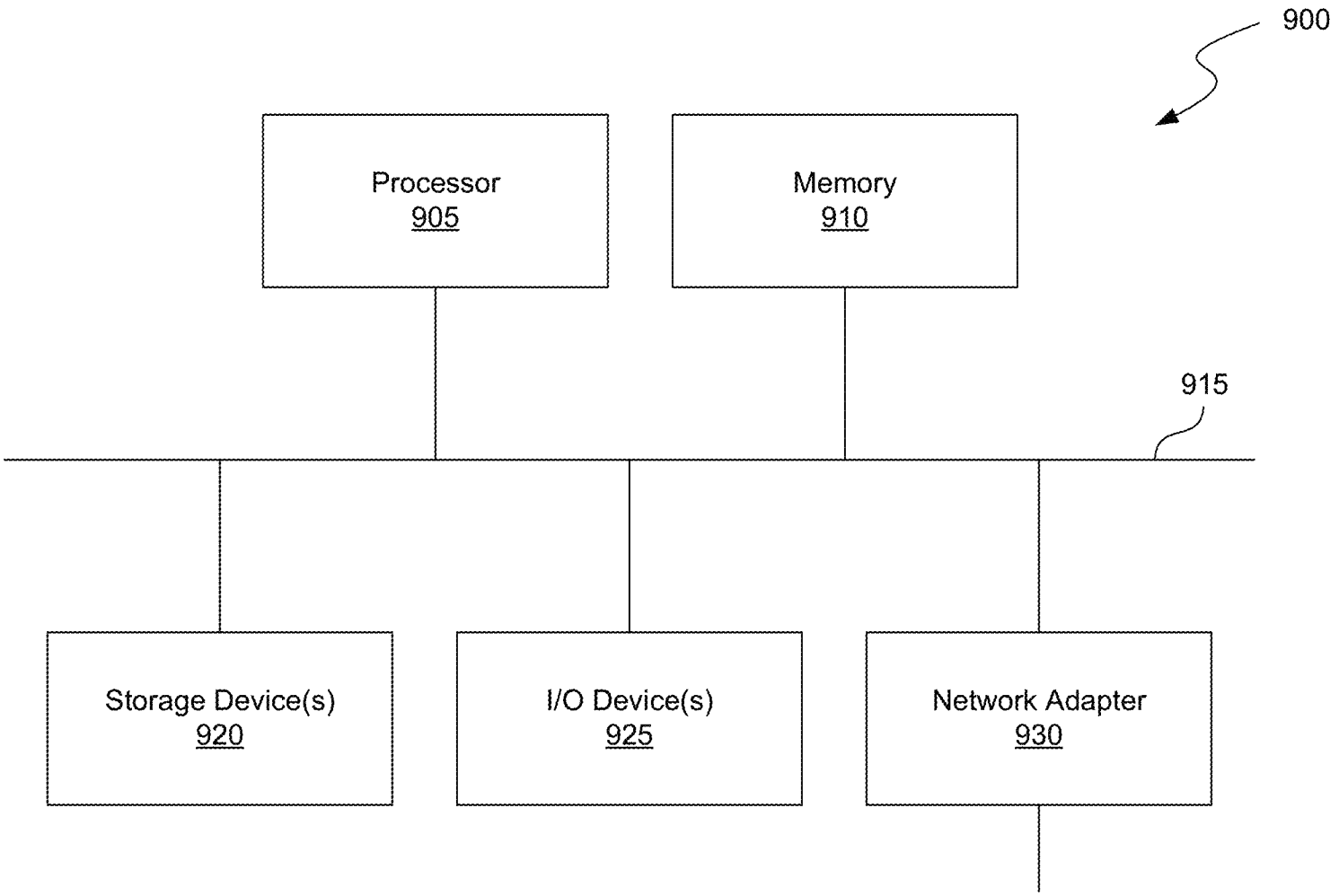
FIG. 9 shows a diagram of an example computing system that may be used to implement features according to some embodiments of the introduced shape packing technique.

The layout planner 702 may comprise a computing system (e.g., such as computing system 900 described with respect to FIG. 9) configured to execute instructions for carrying out processes to implement the introduced technique for shape packing based on the received inputs. In other words, the layout planner 702 may include a processor executing instructions stored in memory to process the received inputs to define a target shape based on the information 706 regarding the substrate, pre-group the candidate items into potential blocks based on the information 704 regarding the items, and place one or more of the potential blocks into the target shape using a recursive dynamic programming process to arrive at a placement solution.

Once the layout planner generates a layout solution using the introduced technique, the layout planner 702 may output information (e.g., the placement solution, a cutting pattern, cutting instructions, etc.) to a cutting system controller 708, which may then generate control commands configured to cause an automated cutter apparatus 710 (e.g., a guillotine cutter) to perform a cutting process on the substrate 712 based on the layout.

The automated cutter apparatus 710 may include one or more blades capable of cutting the substrate 712 and one or more actuators (e.g., mechanical, electromechanical, hydraulic, pneumatic, etc.) arranged to articulate the one or more blades to cut the substrate 712. The types of blades used will depend on various factors such as the types of cuts (e.g., orthogonal vs. oblique), the thickness of the substrate 712, and/or the material of the substrate 712. In some embodiments, the cutter 710 may include multiple different types of blades that are each used for different scenarios. In some embodiments, the output sent to the cutter controller 708 may specify the types of cuts and characteristics of the substrate 712. The cutter controller 708 will then interpret the information to control the multiple blades of the cutter 710 to most effectively cut the substrate 712 according to a cutting pattern.

Figure 8:
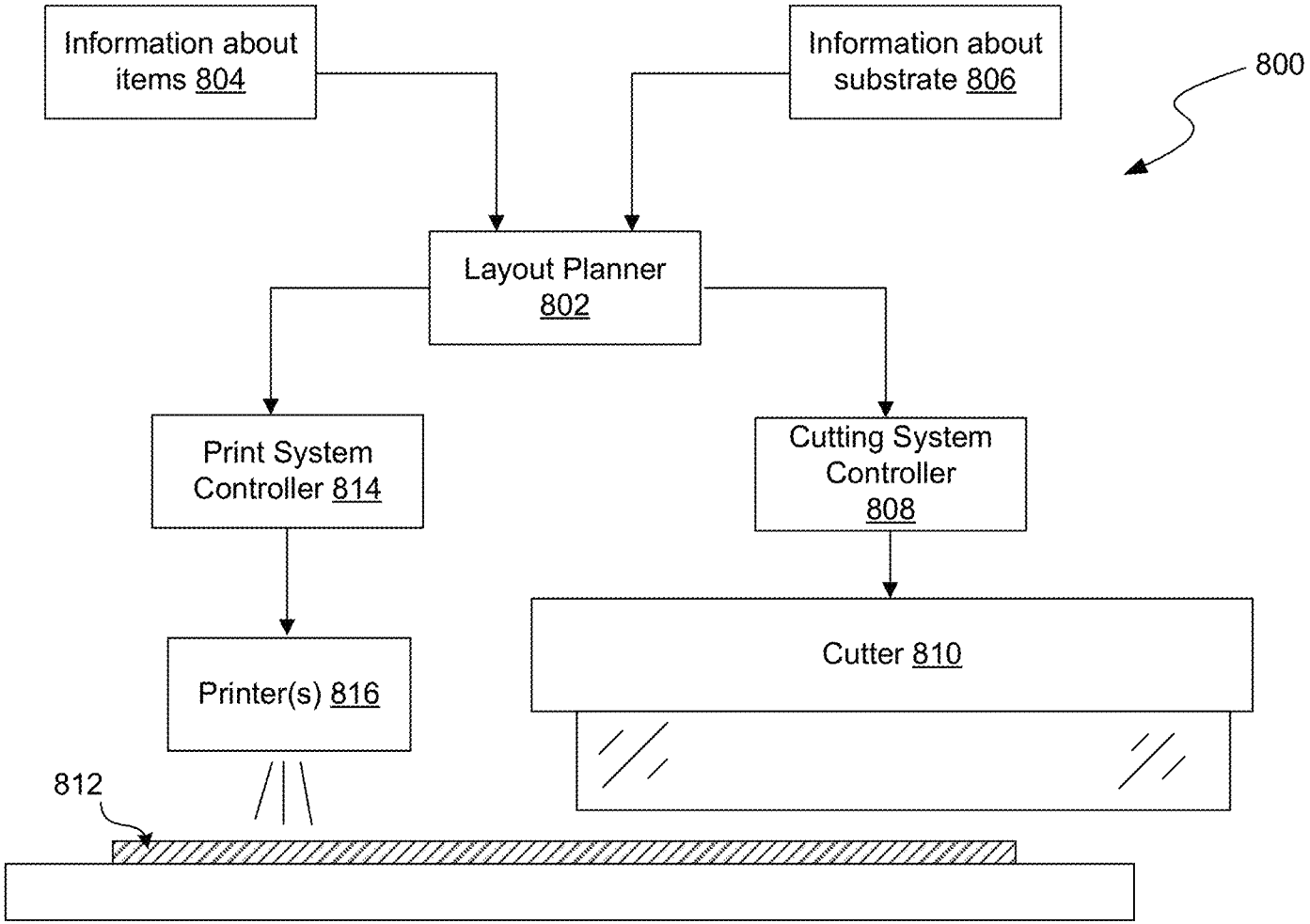
FIG. 8 shows a diagram of an example print production system within which the introduced shape packing technique can be performed.

In some embodiments, the introduced technique may be implemented in a print production pipeline that includes both printing processing and cutting processes. FIG. 8 shows an example print production system 800 that is similar to example system 700, except that it also includes a print system comprising at least a print system controller 814 and one or more printers 816 (e.g., ink jet printers, etc.). Example system 800 also includes a layout planner 802, cutting system controller 808, and cutter 810 which are analogous to the corresponding components 702, 708, and 710 of system 700. As shown in FIG. 8, the layout planner 802 receives information 804 and 806 (analogous to information 704 and 706 of FIG. 7), generates a placement solution based on the information 804 and 806, and generates an output based on the placement solution. For example, the layout planner 802 in system 800 may output both a print pattern and a cutting pattern. The print pattern may be output to the print system controller 814 which may generate the control commands configured to cause the one or more printers 816 to print items (e.g., based on input images) on the substrate 812 according to the print pattern. The cutting pattern may be output to the cutting system controller 808 which may generate control commands configured to cause the cutter 810 to cut the substrate 812 according to the cutting pattern.

In some embodiments, the layout planner 802 may coordinate orders of operations between the printing system and the cutting system. For example, in some embodiments, the layout planner 802 may cause the printer 816 to print on the substrate 812 before causing the cutter 810 to cut the substrate 812. In some embodiments, substrate 812 may be moved (manually or automatically) from the printing system after printing to the cutting system to cut the printed items into individual products according to the generated layout. Although not depicted in FIG. 8, system 800 may also include an automated conveyance system configured to move the substrate 812 after printing to the cutter 810 for cutting.

It shall be appreciated that the systems described with respect to FIGS. 7-8 are examples and are described in simplified terms for illustrative clarity. A person having ordinary skill will recognize that, in practice, similar systems may include more or fewer components than are shown or may order and arrange the components differently, while still remaining within the scope of the disclosed innovation.

Example Computing System

FIG. 9 is a block diagram of an example computer system 900 as may be used to implement certain features of some of the embodiments. The computer system 900 may be a server computer; a client computer; a personal computer (PC); a user device; a tablet PC; a laptop computer; a personal digital assistant (PDA); a cellular telephone; a telephone; a web appliance; a network router, switch or bridge; a console; a hand-held console; a (hand-held) gaming device; a music player; any portable, mobile, hand-held device or wearable device; or any other machine capable of executing a set of instructions (sequential or otherwise) that specify actions to be taken by that machine.

The computing system 900 may include one or more processing units (e.g., central processing units (CPU) and/or graphical processing units (GPU) (collectively the "processor")) 905, one or more memory units (collectively "memory") 910, one or more input/output devices 925 (e.g., keyboard and pointing devices, touch devices, display devices, audio input/output devices, etc.), one or more storage devices 920 (e.g., disk drives, solid state drives, etc.), and one or more network adapters 930 (e.g., network interfaces) that can communicatively couple via an interconnect 915. The interconnect 915 is illustrated as an abstraction that represents any one or more separate physical buses, point-to-point connections, or both connected by appropriate bridges, adapters, or controllers. The interconnect 915, therefore, may include, for example, a system bus, a Peripheral Component Interconnect (PCI) bus or PCI-Express bus, a HyperTransport or industry standard architecture (ISA) bus, a small computer system interface (SCSI) bus, a universal serial bus (USB), IIC (I2C) bus, an Institute of Electrical and Electronics Engineers (IEEE) standard 1394 bus (also called Firewire), or any other suitable system for facilitating communication between the various components of the example computing system 900.

The memory 910 and storage device 920 are computer-readable storage media that may store instructions that implement at least portions of the various embodiments. In addition, the data structures and message structures may be stored or transmitted via a data transmission medium (e.g., a signal on a communications link). Various communications links may be used such as the Internet, a local area network, a wide area network, or a point-to-point dial-up connection, etc. Thus, computer-readable media can include computer-readable storage media, e.g., non-transitory media, and computer-readable transmission media.

The instructions stored in memory 910 can be implemented as software and/or firmware to program the processor 905 to carry out actions described above. In some embodiments, such software or firmware may be initially provided to the processor 905 by downloading the software or firmware from a remote system through the computing system 1500, e.g., via network adapter 930.

The various embodiments introduced herein can be implemented by, for example, programmable circuitry, e.g., one or more microprocessors, programmed with software and/or firmware, or entirely in special-purpose hardwired (non-programmable) circuitry, or in a combination of such forms. Special-purpose hardwired circuitry may be in the form of, for example, one or more ASICs, PLDs, FPGAs, etc.

What is claimed is:

1. A method comprising:

receiving, by a computer system, an input indicative of a plurality of items to be placed in a target shape, each of the plurality of items having a corresponding shape;

in response to the input, sorting the plurality of items into one or more item groups, wherein each of the one or more item groups includes a subset of the plurality of items that satisfy a similarity criterion;

defining a plurality of potential blocks, wherein each of the plurality of potential blocks includes an arrangement of one or more items associated with one of the one or more item groups;

generating a placement solution by placing one or more of the plurality of potential blocks in the target shape using a recursive process that avoids redundant placement solutions until all of the plurality of potential blocks are placed or no other potential blocks are able to be placed, wherein each potential block placed when generating the placement solution includes items that have not yet been placed in the target shape, each potential block fits in the target shape, and each potential block does not represent a potential block that can be produced by a partition to any previously placed potential block; and generating an output based on the placement solution.

2. The method of claim 1, wherein generating the placement solution includes:

performing a solution generation process that includes:

performing a block placement process that includes:

placing a potential block of the one or more potential blocks in the target shape; and defining one or more new target shapes based on one or more remainders of the target shape; and recursively repeating the block placement process until all of the potential blocks are placed or no other potential blocks are able to be placed;

repeating the solution generation process to generate a plurality of different candidate placement solutions;

comparing the plurality of candidate placement solutions; and selecting a particular candidate placement solution that fills the most area of the target shape.

3. The method of claim 2, wherein the block placement process begins by placing a largest potential block of the one or more potential blocks.

4. The method of claim 1, wherein the target shape, the plurality of items, and the one or more potential blocks are all rectangular in shape.

5. The method of claim 1, wherein generating the output includes any of:

generating a print layout based on the placement solution; or generating a cutting pattern based on the placement solution.

6. The method of claim 1, further comprising:

transmitting the output to an automated production system for processing.

7. The method of claim 1, wherein the generated output includes a cutting pattern, the method further comprising:

causing an automated guillotine cutter to cut a substrate into a plurality of partitions corresponding to the plurality of items based on the cutting pattern.

8. The method of claim 7, wherein the target shape is based on a shape of the substrate and wherein the plurality of items are based on shapes of partitions of the substrate to be cut from the substrate using the automated guillotine cutter.

9. The method of claim 7, wherein the generated output further includes a print layout, the method further comprising:

causing a printer to print a plurality of images corresponding to the plurality of items on the substrate based on the print layout before causing the automated guillotine cutter to cut the substrate based on the cutting pattern.

10. The method of claim 1, wherein sorting the plurality of items into one or more item groups includes inputting dimensions associated with plurality of items into a machine learning model, the machine learning model configured to apply a clustering algorithm to sort the plurality of items into the one or more item groups based on the input dimensions.

11. A system comprising:

a processor; and a memory having instructions stored thereon, which when executed by the processor, cause the system to:

receive an input indicative of a plurality of items to be placed in a target shape, each of the plurality of items having a corresponding shape;

in response to the input, sort the plurality of items into one or more item groups, wherein each of the one or more item groups includes a subset of the plurality of items that satisfy a similarity criterion;

define a plurality of potential blocks, wherein each of the plurality of potential blocks includes an arrangement of one or more items associated with one of the one or more item groups;

generate a placement solution by placing one or more of the plurality of potential blocks in the target shape using a recursive process that avoids redundant placement solutions until all of the plurality of potential blocks are placed or no other potential blocks are able to be placed, wherein each potential block placed when generating the placement solution includes items that have not yet been placed in the target shape, each potential block fits in the target shape, and each potential block does not represent a potential block that can be produced by a partition to any previously placed potential block; and generate an output based on the placement solution.

12. The system of claim 11, wherein generating the placement solution includes:

performing a solution generation process that includes:

performing a block placement process that includes:

placing a potential block of the one or more potential blocks in the target shape; and defining one or more new target shapes based on one or more remainders of the target shape; and recursively repeating the block placement process until all of the potential blocks are placed or no other potential blocks are able to be placed;

repeating the solution generation process to generate a plurality of different candidate placement solutions;

comparing the plurality of candidate placement solutions; and selecting a particular candidate placement solution that fills the most area of the target shape.

13. The system of claim 12, wherein the block placement process begins by placing a largest potential block of the one or more potential blocks.

14. The system of claim 11, wherein the target shape, the plurality of items, and the one or more potential blocks are all rectangular in shape.

15. The system of claim 11, wherein generating the output includes any of:

generating a print layout based on the placement solution; or generating a cutting pattern based on the placement solution.

16. The system of claim 11, wherein the generated output includes a cutting pattern, and wherein the memory has further instructions stored thereon, which when executed by the processor, cause the system to further:

cause an automated guillotine cutter to cut a substrate into a plurality of partitions corresponding to the plurality of items based on the cutting pattern.

17. The system of claim 11, wherein the generated output further includes a print layout, and wherein the memory has further instructions stored thereon, which when executed by the processor, cause the system to further:

cause the printer to print a plurality of images corresponding to the plurality of items on the substrate based on the print layout before causing the automated guillotine cutter to cut the substrate based on the cutting pattern.

18. An automated print production system comprising:

a printer;

an automated guillotine cutter; and a computer system communicatively coupled to the printer and automated guillotine cutter, the computer system configured to:

receive an input indicative of a plurality of images to be printed on a substrate;

in response to the input, sort a plurality items corresponding to dimensions of the plurality of images into one or more item groups, wherein each of the one or more item groups includes a subset of the plurality of items that have substantially similar dimensions;

define a plurality of potential blocks, wherein each of the plurality of potential blocks includes an arrangement of one or more items associated with one of the one or more item groups;

generate a placement solution by placing one or more of the plurality of potential blocks in a target shape corresponding to a shape of the substrate using a recursive process that avoids redundant placement solutions until all of the plurality of potential blocks are placed or no other potential blocks are able to be placed, wherein each potential block placed includes items that have not yet been placed in the target shape, the potential block fits in the target shape, and the potential block does not represent a potential block that can be produced by a partition to any previously placed potential block;

generate a print layout and a cutting pattern based on the placement solution;

cause the printer to print the plurality of images corresponding to the plurality of items on the substrate based on the print layout; and cause the automated guillotine cutter to cut the substrate into a plurality of partitions corresponding to the plurality of items based on the cutting pattern after the printer has completed printing the plurality of images on the substrate.

19. The print production system of claim 18, wherein generating the placement solution includes:

performing a solution generation process that includes:

performing a block placement process that includes:

placing a potential block of the one or more potential blocks in the target shape; and defining one or more new target shapes based on one or more remainders of the target shape; and recursively repeating the block placement process until all of the potential blocks are placed or no other potential blocks are able to be placed;

repeating the solution generation process to generate a plurality of different candidate placement solutions;

comparing the plurality of candidate placement solutions; and selecting a particular candidate placement solution that fills the most area of the target shape.

20. The print production system of claim 19, wherein the block placement process begins by placing a largest potential block of the one or more potential blocks.

21. The print production system of claim 18, wherein the target shape, the plurality of items, and the one or more potential blocks are all rectangular in shape.

22. The print production system of claim 18, wherein the substrate is paper print media.

23. The print production system of claim 18, wherein sorting the plurality of items into one or more item groups includes inputting dimensions associated with plurality of items into a machine learning model, the machine learning model configured to apply a clustering algorithm to sort the plurality of items into the one or more item groups based on the input dimensions.

* * * * *